United States Patent [19]

Devan

[11] 4,429,290

[45] Jan. 31, 1984

[54] FLEXI-BEND CORRUGATED WAVEGUIDE

[75] Inventor: Joseph M. Devan, San Diego, Calif.

[73] Assignee: The United States of America as represented by the Secretary of the Navy, Washington, D.C.

[21] Appl. No.: 89,058

[22] Filed: Oct. 29, 1979

[51] Int. Cl.[3] ..... H01P 3/13; H01P 3/14

[52] U.S. Cl. ..... 333/241; 333/242; 333/251

[58] Field of Search ..... 333/241, 242, 251; 138/121

[56] References Cited

U.S. PATENT DOCUMENTS 3,372,352 3/1968 Krank et al. ..... 333/241

4,147,185 4/1979 Hines ..... 138/121

*Primary Examiner*—Paul L. Gensler

*Attorney, Agent, or Firm*—Robert F. Beers; Ervin F. Johnston; Harvey Fendelman

[57] ABSTRACT

An unsymmetrically corrugated $TE_{01}$ mode circular waveguide bend. Unsymmetrical corrugations approximately one-quarter wavelength deep are utilized to suppress energy transfer to other modes inherent in smooth wall circular guide bends. The corrugations are comprised of a plurality of adjacent internal ridges and valleys having substantially parallel walls such that the distance between the parallel walls of the internal ridges are at least twice the distance between the parallel walls of the internal valleys.

11 Claims, 2 Drawing Figures

FLEXI-BEND CORRUGATED WAVEGUIDE

BACKGROUND OF THE INVENTION

The present invention relates generally to the field of waveguides and more specifically to the field of waveguides suitable for providing low loss versatile bending of electromagnetic energy in the $TE_{01}$ circular waveguide mode without generating unwanted parasitic modes. Theory derived for ideal lossless lines shows that when $TE_{01}$ electromagnetic wave enters a bend, energy is transferred from the $TE_{01}$ mode to the $TM_{11}$ mode. The transfer of energy continues until the critical angle is reached where all of the $TE_{01}$ mode has been converted to the $TM_{11}$ mode. Beyond this critical angle, energy is transferred back from the $TM_{11}$ mode to the $TE_{01}$ mode and when a total angle of twice the critical angle is reached, all the energy, in the ideal case, is transferred back into the $TE_{01}$ mode. Since the critical angle is determined by the free space wavelength and the diameter of the waveguide, the critical bend angle is frequency sensitive but bandwidths of about 10% are readily achieved.

The energy transfers in this manner because the $TE_{01}$ and the $TM_{11}$ modes are degenerate, i.e., they have the same phase velocity. Therefore, the energy transfer between modes is a continuous process; the waves add coherently, regardless of where the transfer occurs and the transfer is theoretically independent of the bend radius. Because of this degeneracy, a gradual large radius bend is no better than a more abrupt short radius bend.

If this mode degeneracy is removed by modifying the waveguides so that the phase velocity of the two modes is no longer the same, the transfer of energy between the modes is reduced and gradual large radius bends are better than short radius bends.

Older methods used to remove this degeneracy have utilized threaded copper pipes and dielectric inserts to guide the $TE_{01}$ circular waveguides modes through a bend. These devices, however, are difficult to fabricate out of solid material and are complicated in structure. In addition, the final configuration must be determined at the onset of fabrication. A symmetrical corrugated structure has also been fabricated by crimping brass or beryllium copper to form a flexible section. The disadvantage with this symmetrical configuration is that the symmetrical corrugation disturbs the integrity of the inside conducting wall of the waveguide more than is necessary, thus increasing losses. Also, the use of brass or beryllium copper is lossier by nature than is pure copper. Additionally, it is also difficult to maintain the precise period of the corrugation over a specified length using mechanical crimping methods.

SUMMARY OF THE INVENTION

Since practical electromagnetic energy transmission lines take on various directions over their length, bends are necessary for a typical installation. $TE_{01}$ circular waveguide offers very low losses to electromagnetic energy in the EHF band (30-300 GHz). The major problem in such transmission lines is unwanted mode generation at any deviation from a straight line waveguide. Accordingly, the present invention relates to a "flexi-bend" that is intended to provide for required deviations from straight line waveguide by preventing unwanted mode generation without increasing $TE_{01}$ mode losses and thereby making the low loss $TE_{01}$ mode circular waveguides transmission line practical for general use where standard transmission line losses are excessive, i.e., in the EHF band. The flexi-bend corrugated waveguide described herein provides for low loss, versatile bending of electromagnetic energy in $TE_{01}$ circular waveguide mode without generating unwanted parasitic modes.

Bending of electromagnetic energy without the generation of parasitic modes is accomplished in accordance with the present invention by an unsymmetrically corrugated circular waveguide. The internal walls of the waveguide disclosed herein are comprised of adjacent ridges and valleys, preferably formed by electroforming, and dimensioned such that the width of the internal ridges of the corrugated structure is significantly greater than the width of the internal valleys of the corrugated structure. The corrugations are formed such that there are as many internal valleys as possible per unit length of waveguide and such that the internal ridge width is maximized with respect to the internal valley width.

The flexi-bend corrugated waveguide structure disclosed herein can be used as a fixed $TE_{01}$ circular mode waveguide bend for providing bending from 0° to 180°, as a flexible bend, or a straight section to isolate or prevent mechanical vibration. The flexi-bend corrugated waveguide is also intended for use as a flexible meander line to enable negotiation of tight paths through or between shipboard bulkheads or other structural members.

The principal advantages of the present invention are a 50% performance improvement over previous devices, consistent reproducibility of successful units, decreased bending radius from four inches to 1.5 inches in the EHF band and the versatility of the device in that it can be flexed into a desired complicated bending scheme and fixed permanently to that shape by rigidizing the flexible section with added external material.

OBJECTS OF THE INVENTION

Accordingly, it is the primary object of the present invention to disclose a waveguide electromagnetic energy bending apparatus in which unwanted mode generation is avoided without increasing the desired $TE_{01}$ mode losses.

It is a concomitant object of the present invention to disclose an electromagnetic energy bending apparatus that enables decreased bending radius over prior art devices.

It is a further object of the present invention to disclose a waveguide bending structure that can be flexed into a desired complicated bending scheme and then fixed permanently to that shape.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
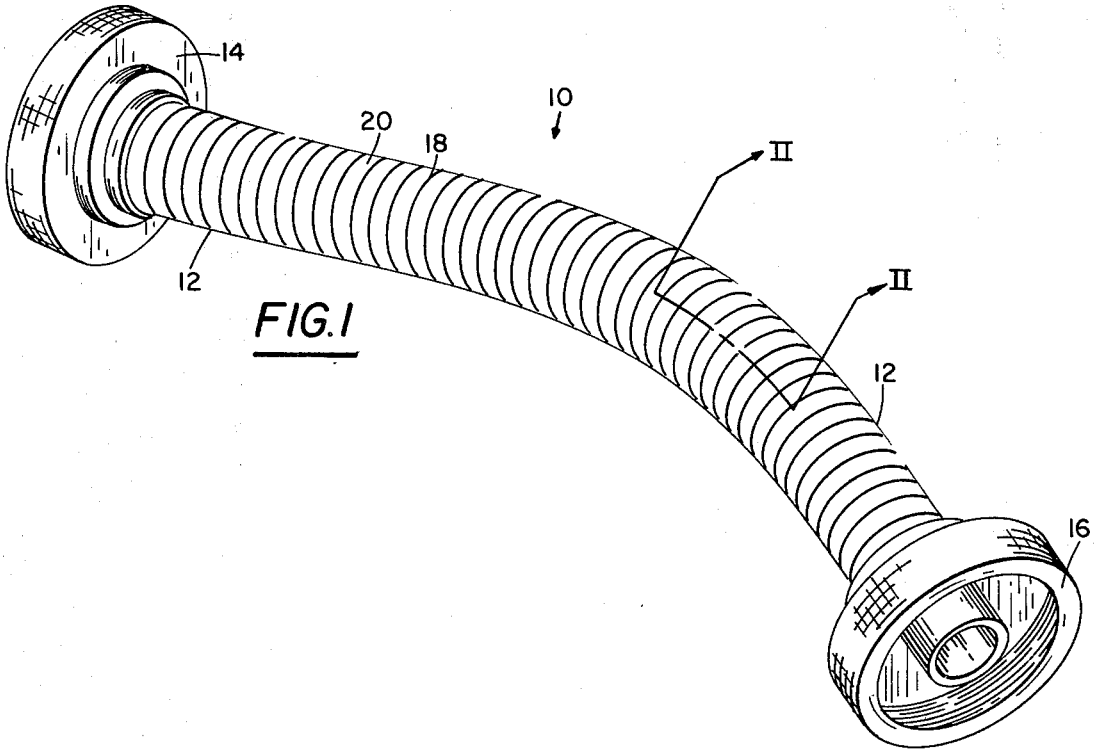
FIG. 1 is a perspective view of the corrugated waveguide structure of the present invention.

Referring now to FIG. 1 there is illustrated the waveguide 10 of the present invention. The waveguide 10 is comprised of a pipe or tube 12 formed from a corrugated metallic material, preferably copper. Attached to each end of the corrugated tube 12 are connectors 14 and 16 which may be of any suitable type, depending on the particular application. The waveguide tube 12, as seen in FIG. 1, is comprised of external corrugation ridges 18 and external corrugation valleys 20. The corrugations 18 and 20 and the tube 12 are preferably formed by electroformation techniques as is well known. Typically, in the electroforming process, an aluminum mandrel (not shown) would be used for formation of the tube 12 thereon. The inside of the tube 12, shown in partial cross section in FIG. 2 would then be electroplated to deposit a surface of copper, after which the aluminum mandrel is chemically etched out. The external surfaces of the tube 12 may be strengthened by the addition of a layer of nickel as is well known. The result of this electroforming process is a flexible corrugated tube 12.

Figure 2:
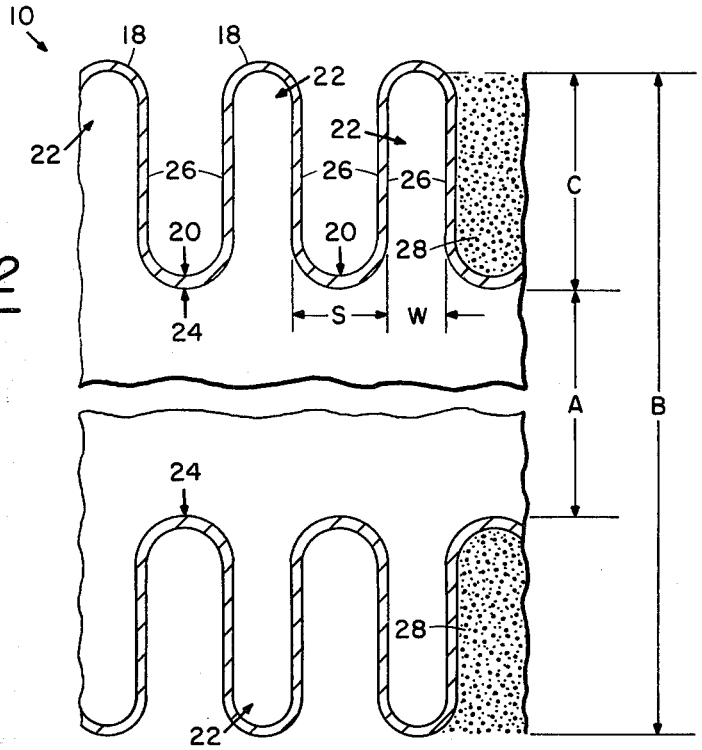
FIG. 2 is a longitudinal cross section taken along lines II–II of FIG. 1.

Referring now to FIG. 2, there is illustrated a partial longitudinal cross section of the waveguide 10 illustrated in FIG. 1. As is seen in FIG. 2, the external ridge 18 forms an internal valley 22 and the external valley 20 forms an internal ridge 24. In order to avoid the generation of unwanted parasitic modes, in accordance with the present invention, the corrugation comprised of the ridges and valleys 22 and 24 are formed so as to be unsymmetrical. Specifically, in the embodiment illustrated in FIG. 2, it is seen that the corrugations include substantially parallel wall portions 26. The distance S between the substantially parallel wall portions 26 of the internal ridges 24 is designed to be at least twice the distance W between the substantially parallel wall portions 26 of the internal valleys 22. The corrugation thus is highly unsymmetrical with a corrugation periodic length, S+W, being at least three times greater than the corrugation width W as opposed to a symmetrical corrugation in which the periodic length is exactly twice the width.

Exemplary values for a flexible waveguide constructed in accordance with the present invention for the dimensions illustrated in FIG. 2 are given below, in inches:

A=0.5 (inside diameter)
B=0.626 (outside diameter)
C=0.07 (corrugation depth)
S=0.04 (internal ridge width)
W=0.02 (internal valley width)

It is noted that the corrugation depth C should be between $\frac{1}{8}$ and $\frac{3}{8}$ wavelength over the frequency band of interest.

The $TE_{01}$ circular waveguide mode energy enters the waveguide corrugated section 10 with minimal or no effect on the circumferential currents required by the mode. However, other possible degenerative or parasitic modes of equal or lower order are generated within the section because these modes require longitudinal wall currents which are severely impeded by the unsymmetrical corrugations formed by the internal ridges 24 and internal valleys 22. Typical unwanted modes are the $TE_{11}$, $TM_{01}$, $TE_{21}$, and $TM_{11}$. The result of utilization of the present invention is minimal attenuation for the $TE_{01}$ modes and prevention of unwanted mode generation over the waveguide bend 10.

The waveguide 10 may be used in its flexible mode or it may be bent and curved as desired and then rigidized as by adding material 28 around the outside of the tube 12.

Obviously, many other modifications and variations of the present invention are possible in the light of the above teachings. It is therefore to be understood that within the scope of the appended claims the invention may be practiced otherwise than as specifically described.

What is claimed is:

1. In a circular waveguide for propagating electromagnetic energy, in the $TE_{01}$ mode, the improvement comprising:

a pipe having corrugated walls, said corrugated walls comprising a plurality of adjacent internal ridges and valleys, having substantially parallel walls, the distance between said substantially parallel walls of said ridges being at least twice the distance between said substantially parallel walls of said valleys.

2. The waveguide of claim 1 wherein said corrugated walls comprise copper walls.

3. The waveguide of claim 2 wherein the external surfaces of said pipe are coated with nickel.

4. In a circular waveguide for propagating electromagnetic energy in the $TE_{01}$ mode, the improvement comprising:

a metallic pipe having corrugated walls, said corrugated walls comprising a plurality of adjacent, internal ridges and valleys having substantially parallel walls, the distance, S, between said substantially parallel walls of said ridges being greater than the distance, W, between said substantially parallel walls of said valleys.

5. The waveguide of claim 4 wherein $S \geqq 2W$.

6. The waveguide of claim 4 wherein said waveguide is comprised of electroformed copper.

7. The waveguide of claim 6 wherein the external surfaces of said pipe are coated with nickel.

8. A waveguide comprising:

means comprising a metallic pipe having a circular cross section for propagating electromagnetic energy in the $TE_{01}$ mode;

said metallic pipe having means for suppressing the propagation of electromagnetic energy through said waveguide in modes other than said $TE_{01}$ mode, said suppressing means comprising a plurality of internal ridges and valleys formed in said metallic pipe and having substantially parallel walls, the distance, S, between said substantially parallel walls of said ridges being greater than the distance, W, between said substantially parallel walls of said valleys.

9. The waveguide of claim 8 wherein $S \geqq 2W$.

10. The waveguide of claim 8 wherein said modes other than said $TE_{01}$ mode include the $TE_{1,1}$, $TM_{0,1}$, $TE_{2,1}$ and $TM_{1,1}$ modes.

11. The waveguide of claims 1, 4 or 8 wherein the depth of said walls is approximately $\lambda/4$ where $\lambda$ is the wavelength at the operating frequency of said waveguide.

* * * * *